US007530750B2

(12) United States Patent
Ho

(10) Patent No.: US 7,530,750 B2
(45) Date of Patent: May 12, 2009

(54) PHOTO PRINTER WITH A VERTICALLY TRANSMITTED PLATEN ROLLER

(75) Inventor: Hui-Chun Ho, Tai-Chung (TW)

(73) Assignee: Lite-On Technology Corp., Neihu, Taipei (TW)

( * ) Notice: Subject to any disclaimer, the term of this patent is extended or adjusted under 35 U.S.C. 154(b) by 628 days.

(21) Appl. No.: 11/279,115

(22) Filed: Apr. 10, 2006

(65) Prior Publication Data

US 2007/0071532 A1 Mar. 29, 2007

(30) Foreign Application Priority Data

Sep. 28, 2005 (TW) ..... 94133752 A

(51) Int. Cl.
*B41J 11/14* (2006.01)
*B41J 11/20* (2006.01)

(52) U.S. Cl. ..... 400/649; 400/120.01

(58) Field of Classification Search ..... None
See application file for complete search history.

(56) References Cited

U.S. PATENT DOCUMENTS 5,212,499 A * 5/1993 Hongo et al. ..... 347/220
6,470,166 B2 * 10/2002 Mizoguchi et al. ..... 399/302
6,963,715 B2 * 11/2005 Kanekura et al. ..... 399/299
2002/0018673 A1 * 2/2002 Mizoguchi et al. ..... 399/298

FOREIGN PATENT DOCUMENTS

| | | | |
|---|---|---|---|
| JP | 10006609 A | * | 1/1998 |
| JP | 2002326421 A | * | 11/2002 |
| JP | 2003-145819 | | 5/2003 |
| JP | 2003136792 A | * | 5/2003 |
| JP | 2003154693 A | | 5/2003 |
| TW | 537201 | | 6/2003 |
| TW | 577826 | | 3/2004 |

* cited by examiner

*Primary Examiner*—Daniel J Colilla
(74) *Attorney, Agent, or Firm*—Winston Hsu

(57) ABSTRACT

In a photo printer, with a translating cam at a horizontal displacement, a platen roller can be lifted up/down vertically to/from a print head. On the profile of the translating cam, there is plurality of concave surfaces and a convex surface as a follower's path. A platen roller frame is used for supporting the platen roller. As the translating cam moves in the track, the roller installed on the platen roller frame rotates on the translating cam's profile. Following the variation of the translating cam's profile, the platen roller frame carries the platen roller to move vertically, so that the platen roller can move to/from the print head in straight line.

10 Claims, 4 Drawing Sheets

PHOTO PRINTER WITH A VERTICALLY TRANSMITTED PLATEN ROLLER

BACKGROUND OF THE INVENTION

1. Field of the Invention

The present invention relates to a photo printer, and more specifically, to a photo printer with a vertically transmitted platen roller.

2. Description of the Prior Art

A thermal printing head (TPH) and a platen roller for carrying a print medium are two necessary parts in a dye-sublimation/thermal photo printer. These two parts are not contacting with each other when the photo printer is not printing but contacting and generating a contact force when the photo printer is printing. The contact force due to the mutual thrust of the TPH and the platen roller ensures that the inserted print medium is grabbed by the TPH and the platen roller and that the TPH can contact the print medium to sublimate dye onto the print medium.

The mechanism that draws the TPH and the platen roller close in a thermal photo printer in the prior art can be classified into two major classes. As disclosed in Japanese publication #P2003145819A, entitled "Thermal Transfer Printer", the first class of mechanism introduces a platen roller frame that supports and brings the platen roller to approach the TPH curvilineally, while the second class of mechanism introduces a TPH frame that moves the TPH to approach the platen roller in a curvilinear manner.

It takes fewer elements for the first class of mechanism, which moves the platen roller by the platen roller frame to approach the TPH curvilineally, than for the second class mechanism. This means that the first class of mechanism is more suitable for applying to small thermal printers such as photo printers that produce 2-inch photos. However, in both the first class of mechanism and the second class of mechanism, the path of approach of the TPH and the platen roller is curvilinear, and therefore a space for a rocker arm, namely the platen roller frame or the TPH frame, is needed. The space must be for the rocker arm's exclusive use. In addition, since the platen roller frame or the TPH frame moves the platen roller or the TPH via a torque, significant rigidity of the frame material is required, and consequently it is nearly unavoidable to use a metal frame, which means higher cost of manufacture.

SUMMARY OF THE INVENTION

Therefore, the primary objective of the claimed invention is to provide a photo printer with a vertically transmitted platen roller to solve the above problem.

The claimed invention provides a photo printer with a vertically transmitted platen roller. The photo printer comprises a housing with a track; a translating cam having a plurality of concave surfaces, the translating cam being installed at a horizontal displacement along the track; a platen roller frame installed on the translating cam for moving vertically along a profile of the translating cam when the translating cam moves in the track horizontally; a platen roller rotatably installed on the platen roller frame; and a print head disposed on one side of the platen roller for printing onto a print medium moving in between the print head and the platen roller.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
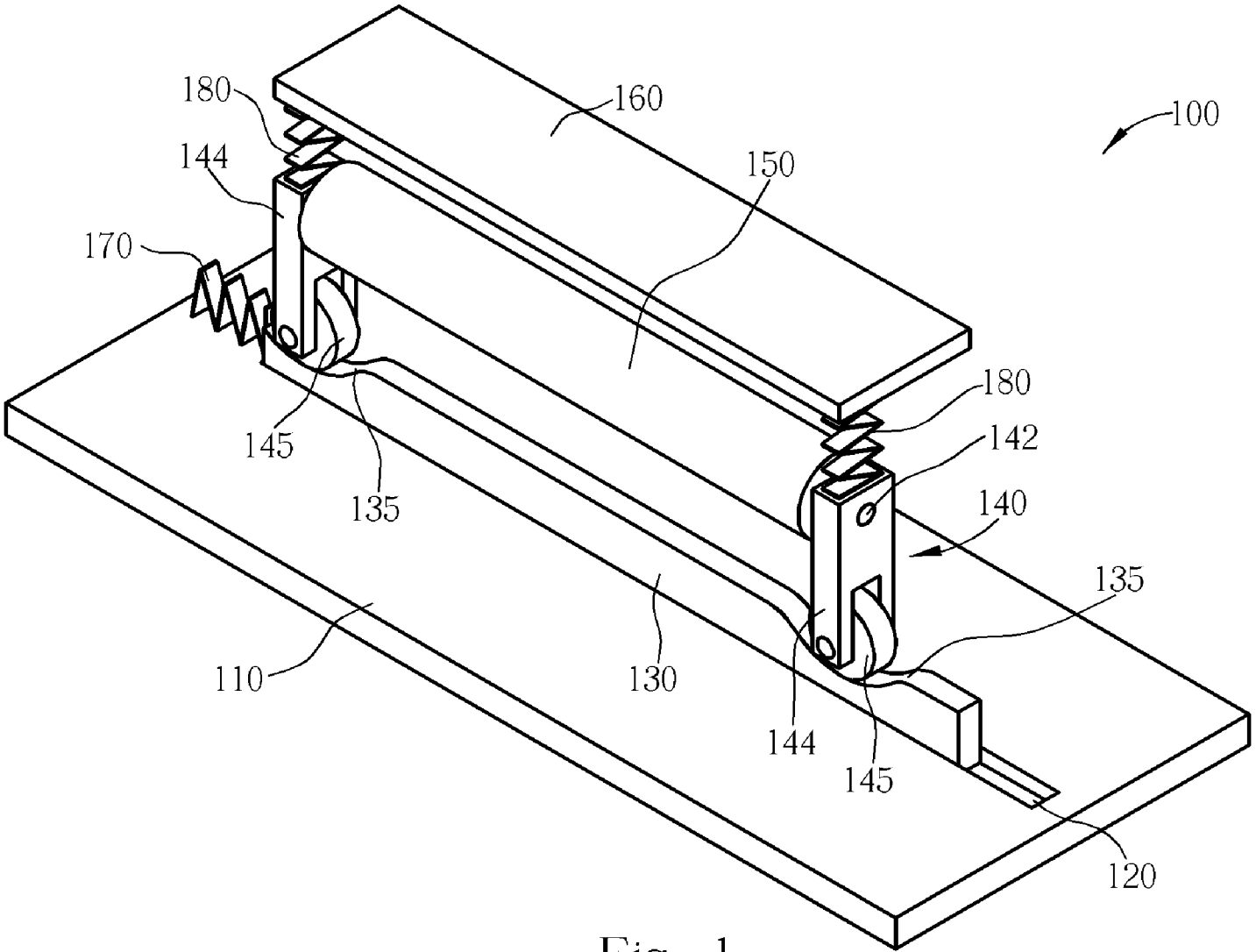
FIG. 1 is an illustration of a photo printer with a mechanism that can move a platen roller vertically.

Please refer to FIG. 1, which is an illustration of a photo printer 100 with a mechanism that can move a platen roller 150 vertically. The photo printer 100 comprises a housing 110 with a track 120, a translating cam 130 having a plurality of concave surfaces 135, a platen roller frame 140, a platen roller 150, a print head 160, and elastic elements 170, 180. The platen roller frame 140 includes two pin frames 144, each comprising a spindle bore 142 and a roller 145.

The translating cam 130 is installed at a horizontal displacement along the track 120, and the platen roller frame 140 is installed on the translating cam 130. The platen roller 150 is rotatably installed on the platen roller frame 140 with the spindle bore 142 of each pin frame 144 for receiving the platen roller 150, allowing the platen roller 150 to rotate along an axle of the platen roller 150 on the platen roller frame 140. The print head 160 is disposed on one side of the platen roller 150 for printing onto a print medium moving in between the print head 160 and the platen roller 150.

Figure 2:
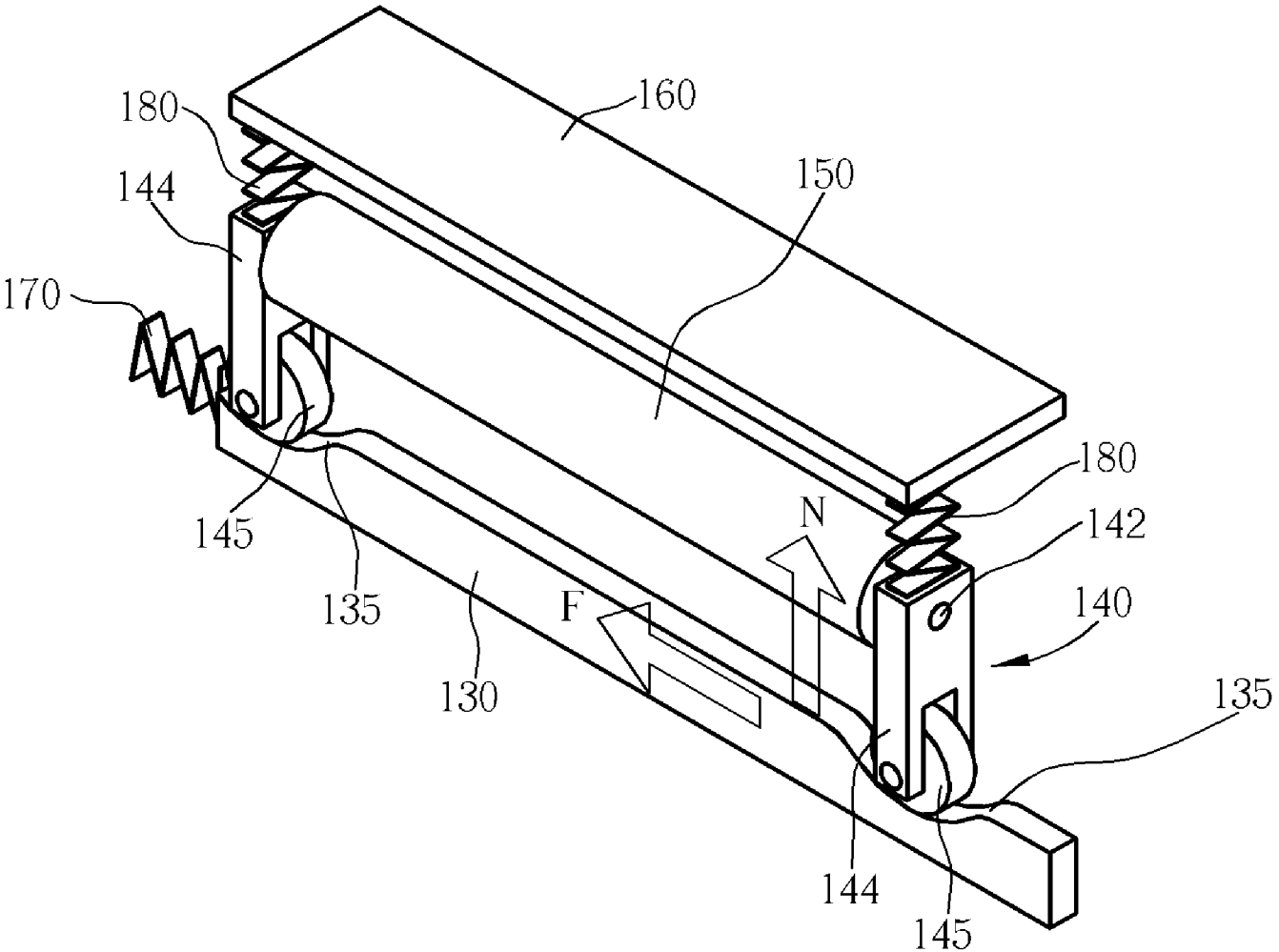
FIG. 2 is an illustration of the platen roller not during printing.
Figure 3:
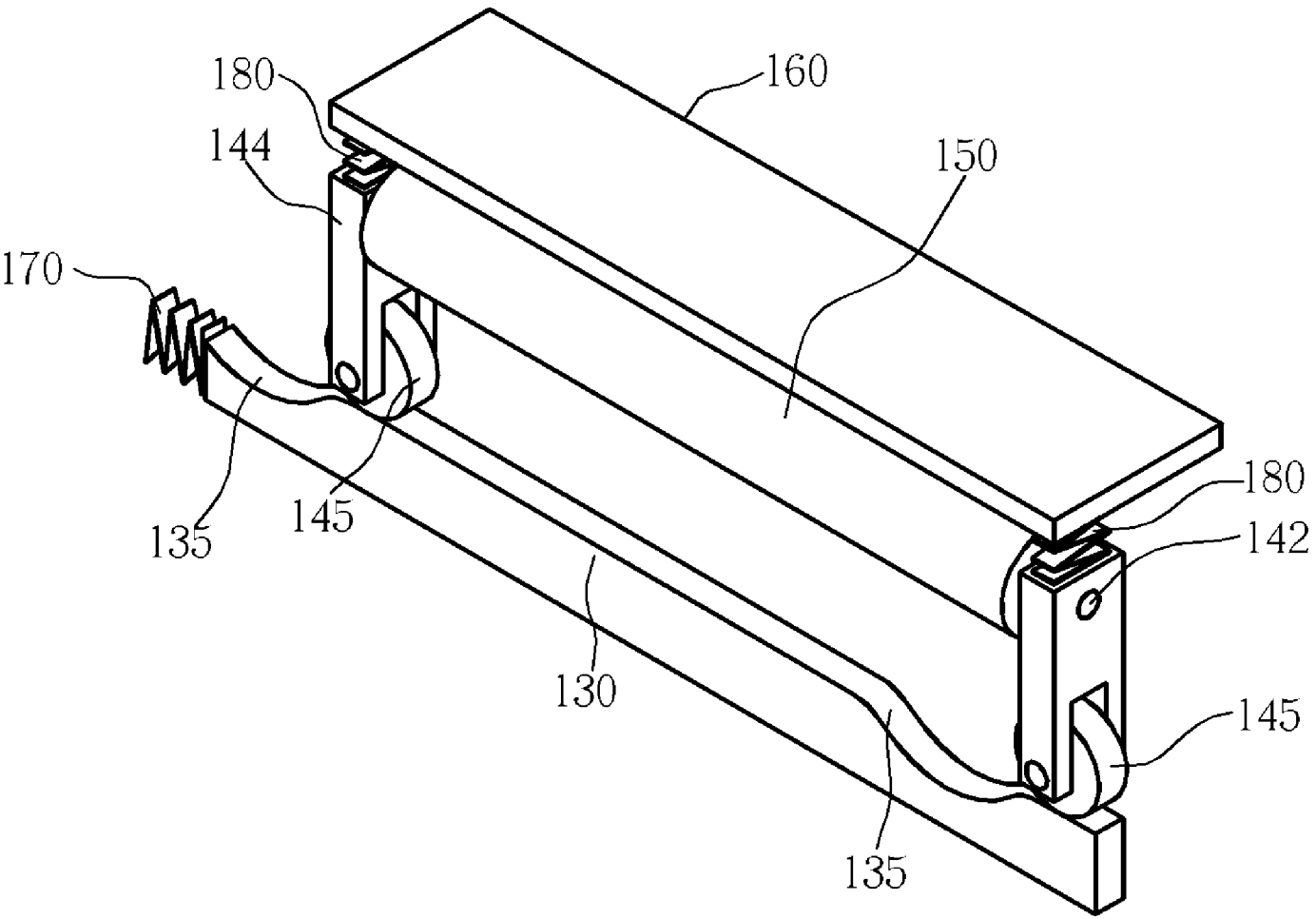
FIG. 3 is an illustration of the platen roller during printing.

Please refer to FIG. 2 and FIG. 3, which describe the movement of the mechanism that moves the platen roller 150 vertically in the photo printer 100 of the present invention. FIG. 2 shows the platen roller 150 when not printing and FIG. 3 shows the platen roller 150 when printing. In FIG. 2, the rollers 145 of the pin frames 144 are located in the concave surfaces 135 and the platen roller frame 140, made up of the two pin frames 144, is then at a lower position. The platen roller 150 is also at a lower position since it is installed on the platen roller frame 140. Because the translating cam 130 can move along the track 120 horizontally, the rollers 145 can rotate on the profile of the translating cam 130 when the translating cam 130 is pushed by a transmission mechanism (not shown in the figure) of the photo printer 100 and moved in the track 120 along a direction F. Since the rollers 145 rotate along a rising curve of the concave surfaces 135 of the translating cam 130, the platen roller frame 140 is driven by the profile of the translating cam 130 to move vertically along the direction N, thus moving the platen roller 150 vertically.

The curvilinear shapes of the concave surfaces 135 of the translating cam 130 are capable of raising the platen roller frame 140 and the platen roller 150 to a needed height with the translating cam 130 moving just in a small distance. As FIG. 3 shows, when the translating cam 130 moves a small distance along the direction F, the profile of the translating cam 130 raises the platen roller frame 140 and the platen roller 150 installed thereon in the direction N to a height that allows the platen roller 150 to contact the print head 160.

An elastic element 170 is connected between one end of the translating cam 130 and the housing 110 of the photo printer 100. When the translating cam 130 moves along the direction F in the track 120 due to the driving force of the transmission mechanism, the elastic element 170 is compressed by the translating cam 130 and provides a restoring thrust on the translating cam 130. There are two more elastic elements 180 connected between the two pin frames 144 of the platen roller frame 140 and the housing 110 of the photo printer 100. When the platen roller frame 140 and the platen roller 150 installed thereon rise, the elastic elements 180 are compressed by the two pin frames 144 and provide a restoring thrust on the platen roller frame 140, just as the elastic element 170 does. The restoring thrust of the elastic elements 180 can further play a part in ensuring that the platen roller frame 140 contacts the profile of the translating cam 130 when the platen roller frame 140 moves on the translating cam 130 since the restoring thrust of the elastic elements 180 constantly pushes the platen roller frame 140 toward the translating cam 130. The transmission mechanism keeps the elastic element 170 compressed in the state shown in FIG. 3, and the translating cam 130 is kept steady also. The elastic elements 170, 180 can be springs.

When the photo printer 100 finishes printing, the transmission mechanism stops pushing the translating cam 130 in the direction F. The restoring thrust of the elastic element 170 takes effect and the elastic element 170 then pushes the translating cam 130 to the opposite direction of F. With the translating cam 130 being pushed by the elastic element 170 and moving in the track 120 to the right, the rollers 145 of the platen roller frame 140 rotate downward on the concave surfaces 135, allowing for the platen roller frame 140 to move downward correspondingly since the restoring thrust exerted upon the platen roller frame 140 by the elastic elements 180 is removed. The platen roller frame 140 along with the platen roller 150 returns to the state shown in FIG. 2.

Figure 4:
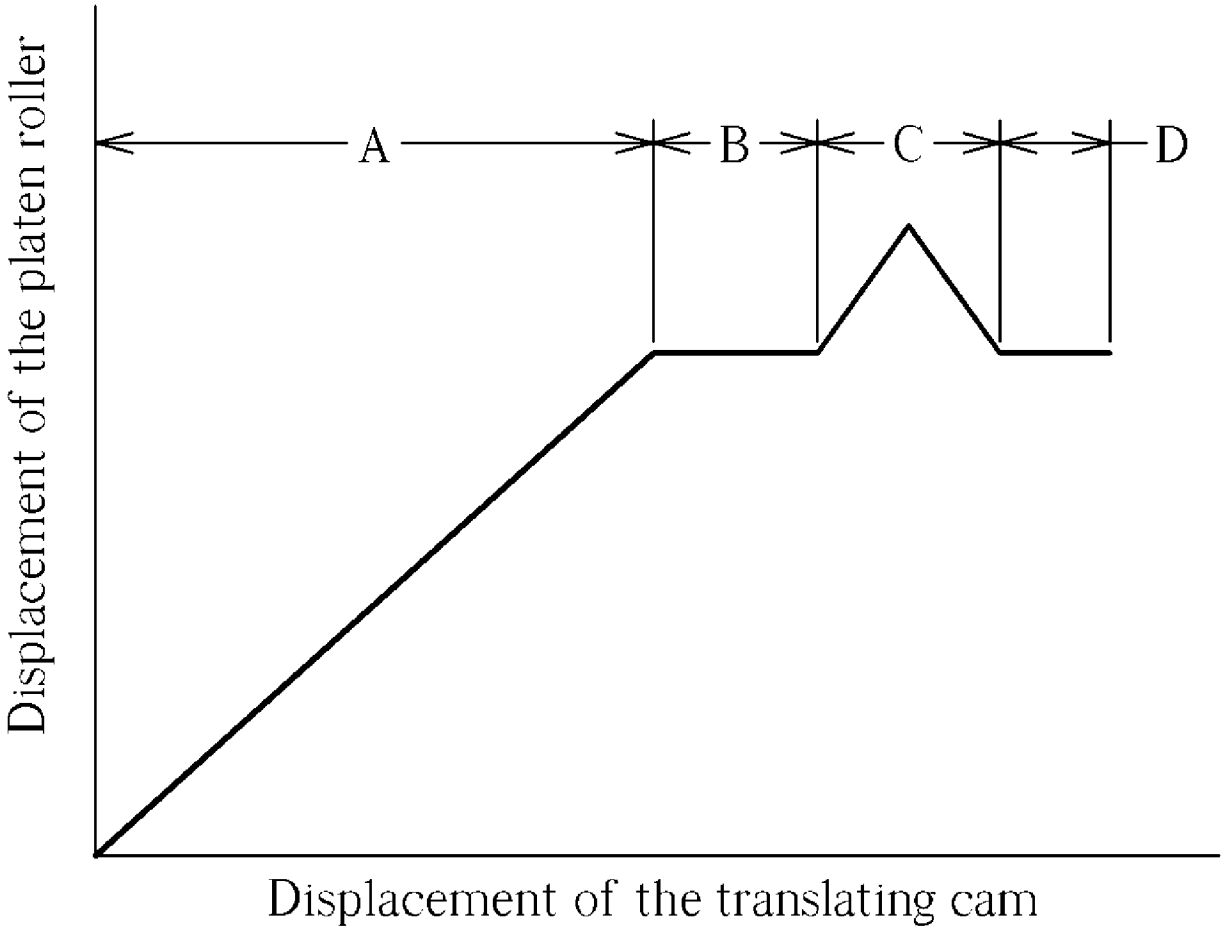
FIG. 4 is a chart of a relation between displacement of the translating cam and displacement of the platen roller.

Please refer to FIG. 4, which is a chart of a relation between displacement of the translating cam 130 and displacement of the platen roller 150. As the translating cam 130 is pushed by the transmission mechanism resulting in horizontal displacement, there are four phases A, B, C, and D that the translating cam 130 will go through. Phase A shows the process of the roller 145 moving from where the platen roller 150 is separate from the print head 160 (the state in which the photo printer 100 is not printing, in FIG. 2) to the state where the platen roller 150 first contacts the print head 160. Phase B shows the process of the initial contact between the platen roller 150 and the print head 160. There is an extra rise in displacement of the platen roller frame 140 of the photo printer 100. When the translating cam 130 keeps moving in the track 120, the translating cam 130 will go through phase C. At phase C, the roller 145 is further lifted by a convex surface, raising the platen roller frame 140 and the platen roller 150 so that the platen roller 150 gets even closer and contacts more tightly the print head 160 compared to the contact in phase B. Phase C can function since a typical platen roller 150 is made of rubber and thus has surface elasticity. Finally the translating cam 130 moves to the position in phase D, returning the platen roller 150 to a height that offers normal contact with the print head 160, as in phase B. In phase D the convex surface can further play a part in restricting the roller 145 from rotating when the roller 145 leaves the concave surface 135 of the translating cam 130.

Additionally, the track 120 in the present invention is fixed on the housing 110 with one end of the track 120 being horizontally adjustable. The horizontal adjustability of one end of the track 120 ensures that the platen roller 150 installed on the track 120 has a contact line with the print head 160, which generates necessary contact force on the print medium.

With the mechanism that can move the platen roller 150 vertically, the photo print 100 of the present invention requires less components and simpler fabrication than the prior art photo printer. The curvilinear property of the concave surfaces reduces the force needed to move the platen roller vertically. Last but not least, the size of a photo printer can be further reduced compared to the prior art mechanism, which moves a platen roller to a print head in a curvilinear manner, since the photo printer of the present invention employs a horizontal moving translating cam to move the platen roller vertically.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A photo printer with a vertically transmitted platen roller comprising:

a housing with a track;

a translating cam having a plurality of concave surfaces, the translating cam being installed at a horizontal displacement along the track;

a platen roller frame installed on the translating cam for moving vertically along a profile of the translating cam when the translating cam moves in the track horizontally;

a platen roller rotatably installed on the platen roller frame; and a print head disposed on one side of the platen roller for printing onto a print medium moving in between the print head and the platen roller.

2. The photo printer of claim 1 wherein the platen roller frame comprises a plurality of rollers for rotating on the profile of the translating cam for driving the platen roller frame vertically when the translating cam moves in the track.

3. The photo printer of claim 1 wherein the platen roller frame comprises two pin frames, each comprising:

a spindle bore for receiving the platen roller allowing the platen roller to rotate along an axle of the platen roller on the platen roller frame; and a roller for rotating on the profile of the translating cam.

4. The photo printer of claim 3 wherein the profile of the translating cam further comprises a convex surface for restricting the roller from rotating when the roller leaves a concave surface of the translating cam.

5. The photo printer of claim 1 further comprising an elastic element connected between one end of the translating cam and the housing for providing a restoring thrust on the translating cam.

6. The photo printer of claim 5 wherein the elastic element is a spring.

7. The photo printer of claim 1 further comprising a plurality of elastic elements connected between the platen roller frame and the housing for providing a restoring thrust on the platen roller frame.

8. The photo printer of claim 7 wherein the plurality of elastic elements is a plurality of springs.

9. The photo printer of claim 1 wherein the track is fixed on the housing with one end of the track being horizontally adjustable.

10. The photo printer of claim 1 wherein the plurality of concave surfaces are curved.

* * * * *